United States Patent [19]

Ackerman

[11] 4,009,743

[45] Mar. 1, 1977

[54] ROOFING TOOL

[76] Inventor: Leonard D. Ackerman, Box 113, Conyngham, Pa. 18219

[22] Filed: Feb. 24, 1976

[21] Appl. No.: 661,008

[52] U.S. Cl. ..... 145/1 A; 30/169

[51] Int. Cl.[2] ..... B66F 15/00

[58] Field of Search ..... 145/1 A; 254/131, 131.5; 30/169, 295; 29/278

[56] References Cited

UNITED STATES PATENTS

| | | | |
|---|---|---|---|
| 1,218,145 | 3/1917 | Whittier | 145/1 A |
| 2,174,646 | 10/1939 | Whitmer | 30/295 |
| 3,587,121 | 6/1971 | Morrow | 254/131 X |
| 3,836,119 | 9/1974 | Saucier | 254/131 |
| 3,945,065 | 3/1976 | Dushku | 254/131 X |

*Primary Examiner*—Al Lawrence Smith
*Assistant Examiner*—J. C. Peters
*Attorney, Agent, or Firm*—Clarence A. O'Brien; Harvey B. Jacobson

[57] ABSTRACT

A manually manipulatable tool which is intended for use in roofing repair, namely, for removing resilient composite roof shingles for replacement. The tool comprises a narrow elongated bowed blade or rocker bed having prying means at its working end, which prying means is adapted to be inserted beneath the free edge of the shingle and to dislodge the nails which hold the shingle to the roof. The tool further comprises a handle on the upper surface of the blade distant from the working end, which tool is meant by its weight and configuration to be held by one hand and used in a natural underhand swing motion of the arm to accomplish dislodgment of the shingle. The handle is equipped with a shield to protect the worker's hand from abrasion, cutting and impact.

10 Claims, 3 Drawing Figures

Fig. 1
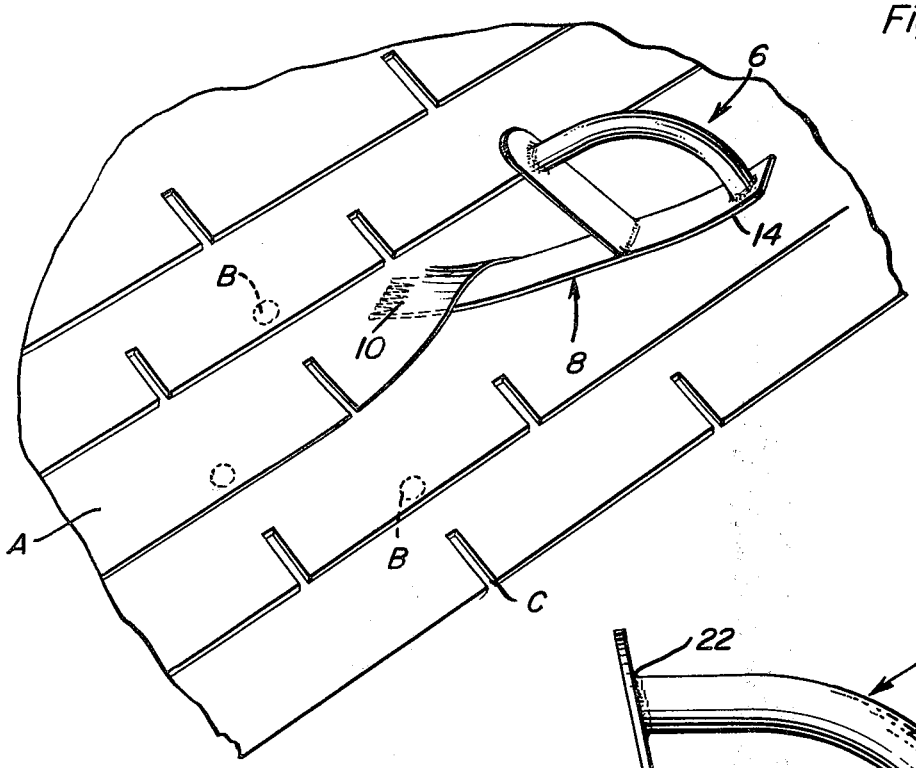
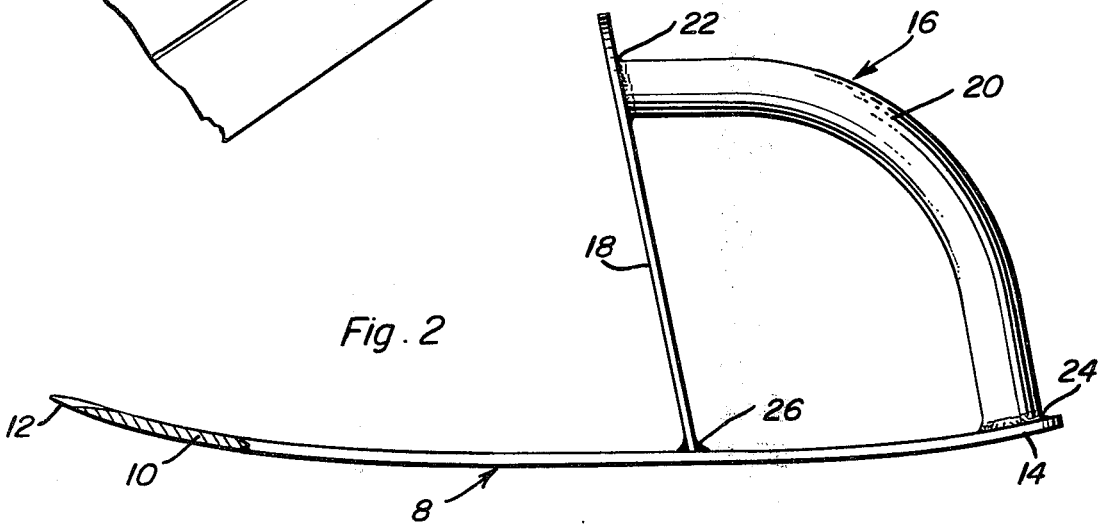
Fig. 2
Fig. 3
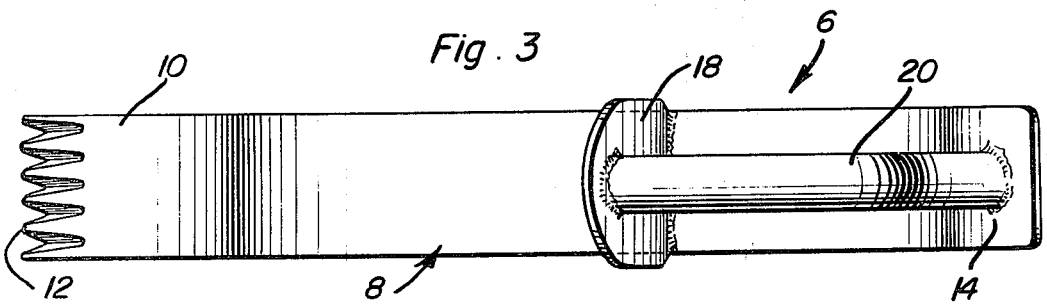

ROOFING TOOL

BACKGROUND OF THE INVENTION

1. Field of the Invention

In shingled roofs, the shingles come in rectangular sections or sheets, the lower portion of which are divided by vertical slits or cutouts spaced equi-distantly along the bottom longitudinal edge, and extending upwardly approximately half the width of the shingle to simulate separate block-like configurations. The shingles are laid in horizontal rows starting in most roofs from the eaves or bottom line of the roof. The first row is laid across and nailed at points approximately 5/8 of an inch above the apex of the vertical slits. Each successive layer of shingles is placed with its slits midway the slits of the next lower row so as to provide an alternating brick-like appearance, and each successive row is placed so that the its bottom edge overlaps and covers the nails of the shingle below. To remove a particular shingle, as when patching a roof, it is necessary only to pry-up the nails holding it to the roof, and then slip if from beneath its overlapping contiguous shingle. The present device is designed to slide beneath the overlapping shingle, engage the nail and pry it up and out. Since the stripping tool requires the use of only one hand, the other hand may be employed to remove the shingle.

2. Description of the Prior Art

| | | |
|---|---|---|
| Whittier | No. 1,218,145 | Mar. 6, 1917 |
| Lehman | 1,841,135 | Jan. 12, 1932 |
| Saucier et al. | 3,836,119 | Sep. 17, 1974. |

The Lehman, Whittier and Saucier at el patents all disclose tools for removing roofing material, each having a prying forward edge and a long rigid handle to be worked by both hands as a lever. Whittier further discloses a forward serrated edge to engage the nails. The present device is lightweight, compact and designed to be held in one hand while in use.

SUMMARY OF THE INVENTION

One object of the invention is to strip composite roofing shingles by means of a tool designed to be held in one hand for the prodding and prying operation allowing the other hand to remain free to aid in retaining the user's balance as well as slipping out the loosened shingle. A special object of the invention is in the process of patching a roof to remove a particular damaged shingle without disturbing the contiguous shingles in good condition.

Another object of the invention is to design a tool which is symmetrical with respect to its longitudinal axis so that it may be used ambidextrously, that is with either hand.

A still further object of the invention is to take advantage of the natural underhand swing of the user's arm and the natural grasp of the handle to effectuate rocker action of the tool with an economy of effort, so that it can be used with one hand.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the roof stripper tool slipped beneath the overlapping edge of a roof shingle.

FIG. 2 is a side view of the roof stripper tool with the prying end broken away to show the nail engaging portion.

FIG. 3 is a top view of the roof stripper tool.

DESCRIPTION OF THE PREFERRED EMBODIMENT

In FIG. 1 a portion of the roof is shown with the resilient shingles A held down by nails B (shown in dotted lines to indicate their placement beneath the shingles). These nails B are attached to the roof above the vertical slits C of the shingles. The shingle stripper generally designated as 6 is shown with its prying edge inserted beneath and picking up the free edge of an overlapping shingle.

Referring now to the views of the drawings, separately and together, it will be evident that the device 6 comprises a rocking bed or blade 8 which is made of a rigid but resilient material such as spring steel and is longitudinally bowed and balanced for lever action. The forward upturned end of the blade 8 is designated generally as 10 and constitutes the working or prying end of the device. It is provided with serrations 12, as shown in FIGS. 2 and 3, to engage the shanks of the roofing nails. These serrations 12 are beveled on their top surface only. The handle of the stripper is generally designated as 16 and comprises a hand grip 20 and a hand shield 18. The hand grip 20 is of tubular configuration and is arched and secured at its lower end to rocker bed 14 as at 24 by means of welding, brazing, or the like. The hand shield 18 comprises a flat plate having a width approximately ¼ inch at each side, in excess of the width of the rocker bed and tapering at its lower edge to the same width as the rocker bed and rigidly secured thereto at 26 with the included angle facing the hand grip 20 being obtuse due to a forward inclination of the plate. The upper portions of the hand grip 20 and the hand shield 18 are likewise rigidly secured to each other as at 22. The handle 16 extends above the rocker bed but lies within its peripheral confines and at the end remote from the prying end. The placement, configuration and rigidity of the handle provides for leverage and balance. Dimensionally the rocker bed 8 is about 2½ inches wide, so as to be specific in its work, and 17½ inches in length so as to be able to reach beneath the overlapping free shingle edge to the nail beneath and provide sufficient remaining length for leverage to remove the nail. The handle itself is about 7 inches high and accommodates the grip of the user's hand. The tool itself weighs approximately 5¼ pounds so as to be able to be held and used in one hand.

The advantage of the present shingle stripper lies in its unique compact design, lightness in weight and curved bed for a rocker action swing of the hand and arm, all of which combine to allow the present shingle stripper to be used with one hand while the user is standing, kneeling or sitting.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A compact manually manipulatable tool for removing a particular shingle for repair of a roof comprising; means for permitting the pry-up of the nails holding the shingle to the roof by a one hand operation with a rocker action swing of the user's hand and arm including an elongated bowed rocker bed having a concave surface extending the length thereof and a forward prying end which is adapted to be inserted under the free edge of a shingle to dislodge the nails holding it, said rocker bed having a rearward levered end, and a short handle rigidly attached to and extending upwardly from the concave surface of said levered end, whereby said tool may be worked solely with one hand.

2. A tool as in claim 1 wherein the rocker bed is formed of a narrow metallic strip material.

3. A tool as in claim 2 wherein the handle comprises a hand engaging grip and a flat shield plate.

4. A tool as in claim 3 wherein the hand engaging grip is outwardly arched and affixed at its lowest point to the levered end of the rocker bed and at its upper end to the flat shield plate.

5. A tool as in claim 4 wherein the flat shield plate is affixed to the concave surface of the rocker bed at a forward slant and at a distance intermediate the ends of the rocker bed.

6. A tool as in claim 5 wherein the handle lies within the longitudinal confines of the rocker bed.

7. A tool as in claim 6 wherein the hand engaging grip is of rigid tubular construction.

8. A tool as in claim 7 wherein the flat shield plate is substantially wider than the hand engaging grip, and extends widthwise beyond the longitudinal edges of the rocker bed, and is tapered at its base for coextensive attachment to the rocker bed.

9. A tool as in claim 8 wherein the handle occupies about one-third the length of the rocker bed.

10. A tool as in claim 9 wherein the prying end is serrated to engage the shank portion of a roofing nail, said serrations being beveled on their upper surface.

* * * * *